US010589326B2

(12) United States Patent
Yamauchi

(10) Patent No.: US 10,589,326 B2
(45) Date of Patent: Mar. 17, 2020

(54) METHOD FOR MANUFACTURING LINEAR CUTTER, AND ROLLER DIE DEVICE FOR MOLDING LINEAR CUTTER

(71) Applicant: YAMAUCHI MATEX CORPORATION, Fukui-shi, Fukui (JP)

(72) Inventor: Ryuji Yamauchi, Fukui (JP)

(73) Assignee: YAMAUCHI MATEX CORPORATION, Fukui-Shi, Fukui (JP)

( * ) Notice: Subject to any disclaimer, the term of this patent is extended or adjusted under 35 U.S.C. 154(b) by 174 days.

(21) Appl. No.: 15/564,120

(22) PCT Filed: Dec. 19, 2016

(86) PCT No.: PCT/JP2016/087704
§ 371 (c)(1),
(2) Date: Oct. 3, 2017

(87) PCT Pub. No.: WO2017/138257
PCT Pub. Date: Aug. 17, 2017

(65) Prior Publication Data

US 2018/0078980 A1 Mar. 22, 2018

(30) Foreign Application Priority Data

Feb. 12, 2016 (JP) ..... 2016-024353

(51) Int. Cl.
*B21B 1/16* (2006.01)
*B26D 1/00* (2006.01)
(Continued)

(52) U.S. Cl.
CPC ..... *B21B 1/166* (2013.01); *B21F 45/00* (2013.01); *B21H 7/10* (2013.01); *B21H 8/00* (2013.01);
(Continued)

(58) Field of Classification Search
CPC .. B21B 1/16; B21B 1/166; B21B 1/08; B21H 7/06; B21H 7/10; B21H 8/00; B21H 8/02;
(Continued)

(56) References Cited

U.S. PATENT DOCUMENTS 2,184,150 A * 12/1939 Parker ..... B21D 53/64 148/652
2,868,042 A 1/1959 Bakos

FOREIGN PATENT DOCUMENTS

FR 2213817 A1 * 8/1974 ..... B21H 7/10
JP 547-42568 A 12/1972
(Continued)

OTHER PUBLICATIONS

PCT/ISA/210, "International Search Report for International Application No. PCT/JP2016/087704," dated Mar. 21, 2017.

*Primary Examiner* — Debra M Sullivan
(74) *Attorney, Agent, or Firm* — Manabu Kanesaka

(57) ABSTRACT

A method for manufacturing a linear cutter permits continuous manufacturing of linear cutters and achieving remarkable reduction in processing steps, processing time, and a process cost, and is immediately feasible to linear cutters having special lengths. The method includes the steps of: preparing a pair of roller dies for forming a die hole for processing a wire rod into a predetermined shape, the die hole having keen angle parts for forming a cutting edge; and causing the wire rod to pass through the die hole in a state that the roller dies revolve and thereby forming a sectional shape of the wire rod into a pre-set shape and, at the same time, forming a cutting edge at least at one edge of the wire rod.

11 Claims, 5 Drawing Sheets

(51) Int. Cl.

| | |
|---|---|
| ***B21F 45/00*** | (2006.01) |
| ***B21H 7/10*** | (2006.01) |
| ***B21H 8/00*** | (2006.01) |
| *B26D 1/04* | (2006.01) |
| *B26D 7/10* | (2006.01) |

(52) U.S. Cl.
CPC ..... *B26D 1/0006* (2013.01); *B26D 1/04* (2013.01); *B26D 7/10* (2013.01)

(58) Field of Classification Search
CPC ..... B21H 7/007; B21D 53/64; B21D 53/645; B21F 45/00
See application file for complete search history.

(56) References Cited

FOREIGN PATENT DOCUMENTS

| | | | |
|---|---|---|---|
| JP | 551-12371 | A | 1/1976 |
| JP | 2505610 | Y2 | 7/1996 |
| JP | H10-225898 | A | 8/1998 |
| JP | 2006-075453 | A | 3/2006 |

* cited by examiner

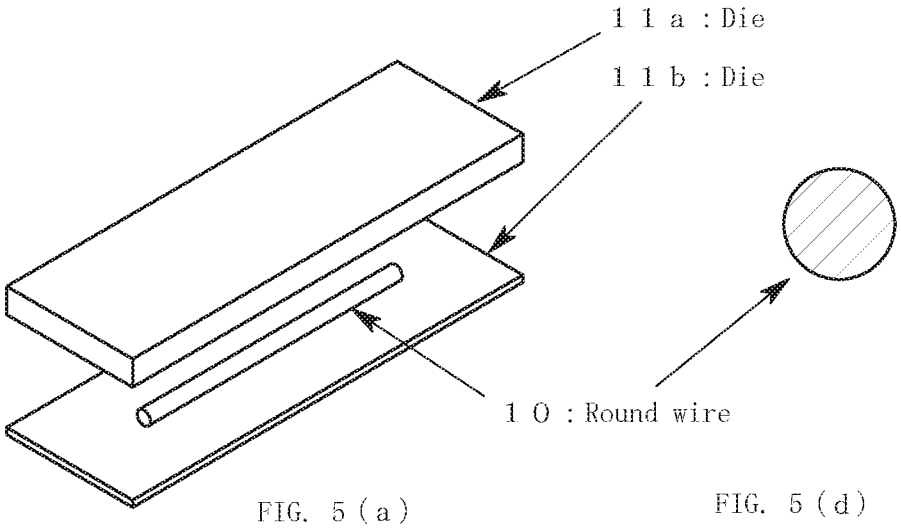
FIG. 5 (a)
FIG. 5 (d)
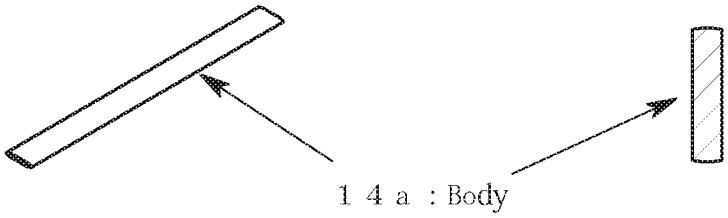
FIG. 5 (b)
FIG. 5 (e)
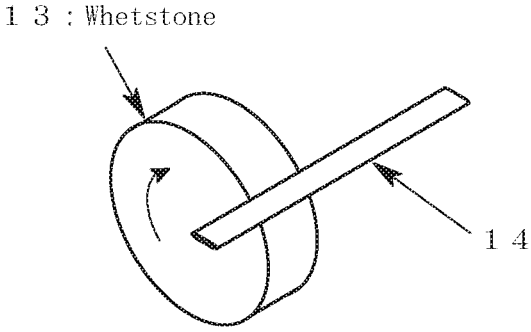
FIG. 5 (c)
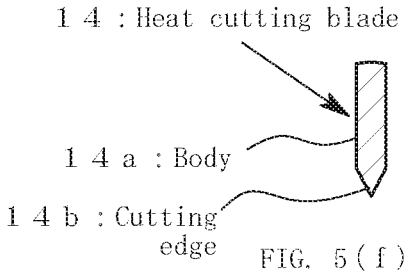
FIG. 5 (f)

METHOD FOR MANUFACTURING LINEAR CUTTER, AND ROLLER DIE DEVICE FOR MOLDING LINEAR CUTTER

RELATED APPLICATIONS

The present application is National Phase of International Application No. PCT/JP2016/087704 filed Dec. 19, 2016, and claims priority from Japanese Application No. 2016-024353, filed Feb. 12, 2016, the disclosure of which is hereby incorporated by reference herein in its entirety.

TECHNICAL FIELD

The present invention relates to: a method for manufacturing a linear cutter in which a cutting edge is formed at least at one edge of a body formed in a linear shape; and a roller die device used in this method.

BACKGROUND ART

For example, in manufacturing of an interior material for automobiles formed by bonding a substrate and a surface material together, the substrate and the surface material are pressure-bonded and joined together between an upper and a lower die and, at the same time, the surface material is cut by a heat cutting blade (for example, see numeral 6 in the figure of Patent Document 1). Such a heat cutting blade is a kind of linear cutter and, as shown in FIG. 4, includes: a linear body 14*a* cut in advance into a predetermined length in accordance with a usage situation or the like of the heat cutting blade 14 like the shape, the size, or the like of an object material to be cut; and a cutting edge 14*b* formed at least at one edge of the body 14*a*. The heat cutting blade 14 is formed from an electrically conductive linear-shaped material such as nickel chrome alloy and stainless steel. Then, when the heat cutting blade 14 is energized, the heat cutting blade 14 is heated so that the object material can be melted and cut or, alternatively, pressure-bonded and joined.

Meanwhile, in general, such a heat cutting blade (a linear cutter) 14 is fabricated by the process steps shown in FIG. 5. Here, FIGS. 5(*a*), 5(*b*), and 5(*c*) schematically show the manufacturing process for the linear cutter. Then, FIGS. 5(*d*) and 5(*e*) are enlarged views each showing the cross section of each wire rod corresponding to FIG. 5(*a*) or 5(*b*). FIG. 5(*f*) is a sectional view of a completed linear cutter.

First, a metal wire rod (a round wire 10) is prepared that has been cut in advance into a predetermined length in accordance with the usage situation or the like of the heat cutting blade 14. Then, the round wire 10 is set between dies 11*a* and 11*b* of a pressing machine (see FIGS. 5(*a*) and 5(*d*)). Then, the dies 11*a* and 11*b* of the pressing machine are closed together so that the round wire 10 is pressed and thereby a body 14*a* having a flat wire shape of pre-set thickness is formed (see FIGS. 5(*b*) and 5(*e*)). After that, one edge of the body 14*a* is grinded from both sides by using a whetstone 13 so that a cutting edge 14*b* is formed (see FIG. 5 (*c*)). At last, a finishing process such as deburring of the blade edge of the cutting edge 14*b* is performed so that the heat cutting blade 14 is completed (FIGS. 4 and 5 (*f*)).

As such, in the conventional manufacturing process for a linear cutter, a plurality of process steps are necessary like cutting of the round wire, setting to the pressing machine, pressing, extraction from the pressing machine, setting to the grinder, grinding, extraction from the grinder, and finishing. Thus, there has been a problem of long processing time and high cost.

Further, the processing is performed by using a round wire having been cut in advance into a predetermined length. Thus, when an order of a linear cutter having a special length exceeding a standard length is received, the processing need be started from the cutting of a round wire and hence a problem is caused that much time is taken from order receipt to shipment. Further, in such a case, when the length of an ordered linear cutter exceeds the capability of the owned pressing machine, a problem is also caused that the order cannot be accepted or, alternatively, a new pressing machine or new dies need be purchased.

Further, plural kinds of dies and pressing machines corresponding to the lengths of the round wires need be prepared and hence a problem of high facility cost is also caused.

PRIOR ART REFERENCES

Patent Documents

Patent Document 1: Japanese Utility Model Registration No. 2505610 (see numeral 6 in the figure)

DISCLOSURE OF THE INVENTION

Problem to be Solved by the Invention

The present invention has been devised in order to fully resolve the above-mentioned problems. An object thereof is to provide a method for manufacturing a linear cutter that permits continuous manufacturing of linear cutters and achieves remarkable reduction in processing steps, processing time, and a process cost and that is immediately feasible to linear cutters having special lengths; and a roller die device for this purpose.

Means for Solving the Problem

The present invention for achieving the above-mentioned object provides, as described in claim 1, a method for manufacturing a linear cutter including the steps of: preparing a pair of roller dies for forming a die hole for processing a wire rod into a predetermined shape, the die hole having a keen angle part for forming a cutting edge; and causing the wire rod to pass through the die hole in a state that the roller dies revolve and thereby forming a sectional shape of the wire rod into a pre-set shape and, at the same time, forming a cutting edge at least at one edge of the wire rod.

According to this method, when roller dies processing is merely performed in a state that a round wire is inserted into the die hole of the roller dies, processing of a body into a predetermined shape and processing of an edge into a cutting edge can simultaneously be achieved. Further, since grinding is not preferred, a finishing process such as deburring becomes unnecessarily.

In the method of the present invention, a round wire having been cut in advance into a predetermined length may be inserted into the die hole of the roller dies so that a linear cutter having a pre-set length may be molded. Alternatively, as described in claim 2, a configuration may be employed that: the wire rod is continuously supplied to the die hole from a wire rod feed part in which the wire rod is wound in a rolled form; a sectional shape of the wire rod is formed into a pre-set shape and, at the same time, a cutting edge is formed at least at one edge of the wire rod; and, after that, the wire rod is cut into a pre-set length.

The round wire inserted into the die hole of the roller dies is rolled by the pair of roller dies revolving in the inside of the die hole so as to be molded into a shape corresponding to the die hole. At that time, deformation of the round wire progresses not only on the keen angle part side but also on a side opposite to the keen angle part. Thus, as described in claim 3, a configuration may be employed that: the roller dies in which a deformation suppression part is formed on a side opposite to the keen angle part is prepared; and the wire rod having passed through the die hole is caused to abut against the deformation suppression part so that deformation of the wire rod toward a side opposite to the keen angle part is suppressed.

Instead, as described in claim 4, a configuration may be employed that: another roller die is prepared separately from the roller dies; and a rotating edge of the another roller die is inserted into the die hole so that the wire rod is pressed toward the keen angle part side.

Further, at the time of molding of an irregular-shaped material such as a linear cutter, a force acts such that the pair of roller dies may be deviated from each other in a direction parallel to the revolution axes of the roller dies. However, as described in claim 5, when a configuration is employed that the plurality of roller dies for forming the die hole engage with each other in the keen angle part, deviation of the pair of roller dies can be suppressed and hence a precision linear cutter can be formed.

The roller die device used in the above-mentioned method of the present invention is, as described in claim 6, a roller die device including a pair of roller dies for forming a die hole for processing a wire rod into a predetermined shape, wherein a keen angle part for forming a cutting edge at least at one edge of the wire rod is formed in a part of the die hole. As described in claim 7, a configuration may be employed that a deformation suppression part for abutting against the wire rod so as to suppress deformation of the wire rod toward a side opposite to the keen angle part is formed on a side of the roller dies opposite to the keen angle part. Alternatively, as described in claim 8, a configuration may be employed that another roller die inserted into the die hole so as to press the wire rod toward the keen angle part side is provided separately from the roller dies.

Further, as described in claim 9, a configuration may be employed that the plurality of roller dies for forming the die hole engage with each other in the keen angle part.

Effect of the Invention

According to the present invention, linear cutters can continuously be fabricated by using roller dies. This permits remarkable reduction in processing steps, processing time, and a process cost. Further, it is sufficient that a linear cutter having a large length formed continuously is cut into a predetermined length in accordance with the application. Thus, linear cutters having special lengths can immediately be fabricated.

Here, the manufacturing method and the roller die device of the present invention permits manufacturing of precision linear cutters. However, when a higher-precision linear cutter is required, grinding or finishing may be performed after a linear cutter is molded by the manufacturing method and the roller die device of the present invention. Even in such a case, a precision linear cutter can be molded by the manufacturing method and the roller die device of the present invention. This provides an advantage of remarkable reduction in the processing time in these process steps.

BRIEF DESCRIPTION OF THE DRAWINGS

FIGS. 5(*a*) to (5(*f*) are diagrams describing a manufacturing process for a heat cutting blade (a linear cutter) according to a conventional example relevant to the present invention.

DESCRIPTION OF REFERENCE NUMERALS

1 Round wire
1A, 1B Round wire feed part
2 Roller die
2*a*, 2*a*' Contact surface
2*b* First rolling formation surface
2*c* Second rolling formation surface
2*d* Protrusion
3 Revolution axis
4 Another roller die
14 Linear cutter
14*a* Body
14*b* Cutting edge
C, C1, C2 Revolution axis

BEST MODE FOR CARRYING OUT THE INVENTION

Preferred embodiments of the present invention are described below in detail with reference to the drawings.

Figure 1:
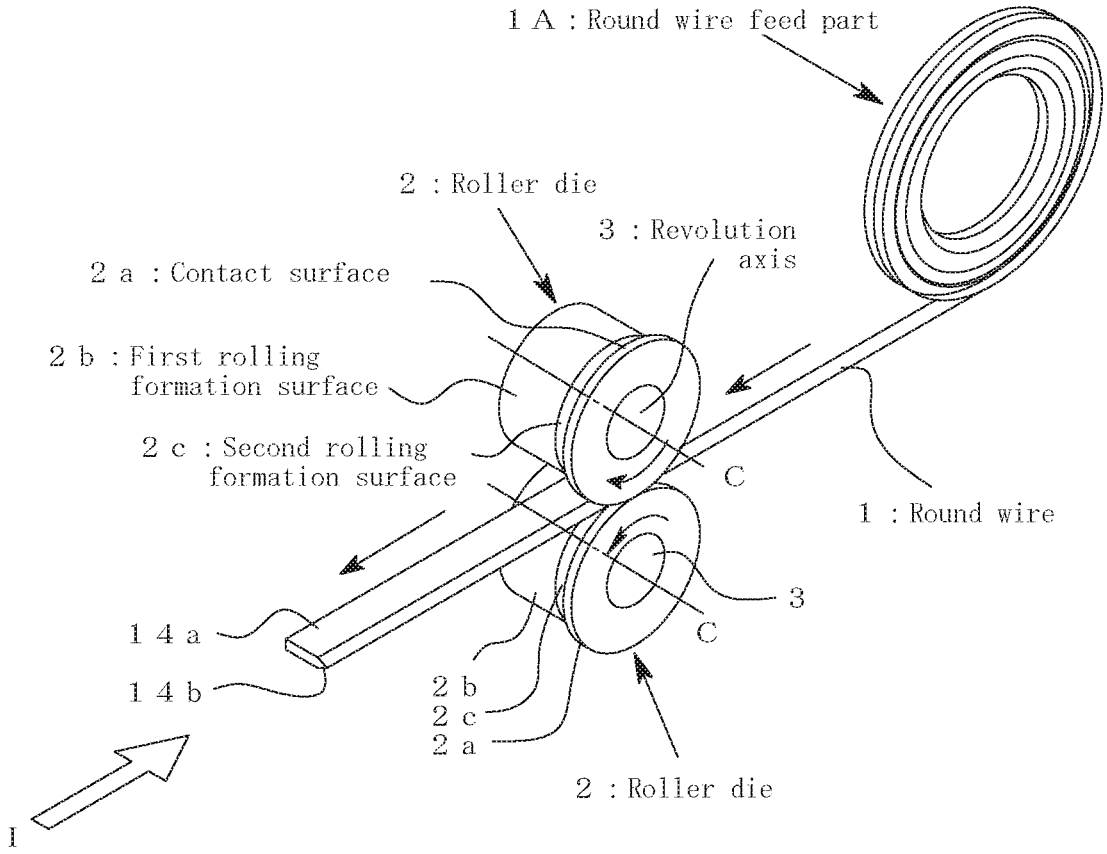
FIG. 1 is an explanation diagram of a principal part of a roller die device used in a method for molding a linear cutter of the present invention.

FIG. 1 is an explanation diagram of a principal part of a roller die device used in a method for molding a linear cutter of the present invention.

The roller die device includes: a pair of roller dies 2 and 2 arranged opposite to each other; a round wire feed part 1A in which a round wire 1 having a cross section of circular shape and serving as a wire rod is wound; and a guide (not shown) for guiding the round wire 1 fed from the round wire feed part 1A, to a position between the roller dies 2 and 2.

The roller dies 2 and 2 respectively include: contact surfaces 2*a* and 2*a* in contact with each other; first rolling formation surfaces 2*b* and 2*b* respectively formed at positions retracted from the contact surfaces 2*a* and 2*a* and formed in parallel to the revolution axes C and C of the roller dies 2 and 2; and inclined second rolling formation surfaces 2*c* and 2*c* respectively joining together the first rolling formation surfaces 2*b* and 2*b* and the contact surfaces 2*a* and 2*a* so as to form a keen angle part. Then, a region surrounded by the first rolling formation surfaces 2*b* and 2*b* and the second rolling formation surfaces 2*c* and 2*c* form a die hole for molding the round wire 1 into a predetermined shape. The round wire 1 fed from the round wire feed part 1A is caused to continuously pass through the die hole formed between the pair of roller dies 2 and 2 so that a body 14*a* is formed by the first rolling formation surfaces 2*b* and 2*b* and, at the same time, a cutting edge 14*b* is formed by the second rolling formation surfaces 2*c* and 2*c*. Then, a linear cutter 14 having a large length molded continuously as such is cut into a desired length at a later process step when necessary.

Figure 2:
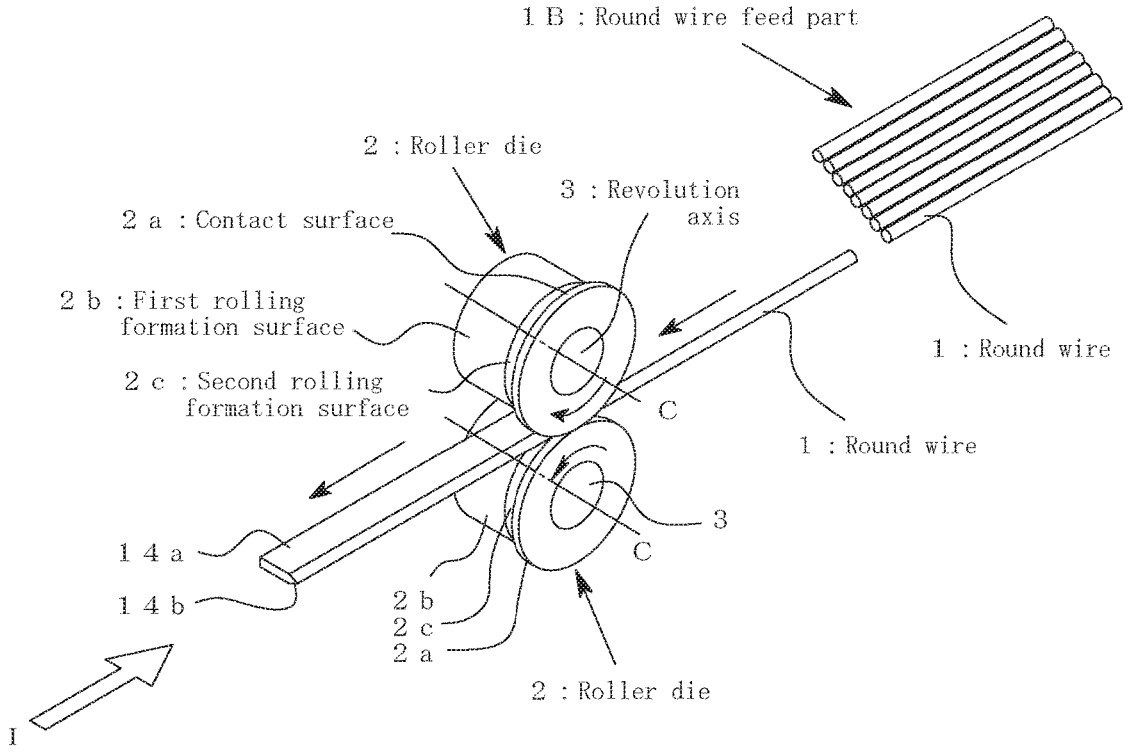
FIG. 2 is an explanation diagram of a principal part of a roller die device used in a method for molding a linear cutter according to another embodiment of the present invention.
Figure 3A:
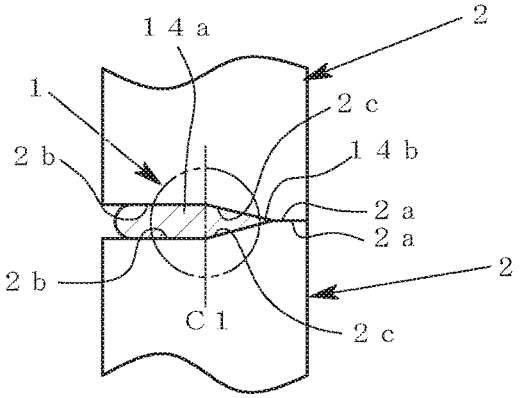
FIGS. 3(*a*) to 3(*d*) show various modes of the die hole in the roller die device of FIG. 1 or 2 and situations that each part of a linear cutter 14 is formed by these die holes, which are given in the form of partial enlarged views where roller dies 2 and 2 are viewed from an arrow-I direction in FIG. 1 or 2.
Figure 3B:
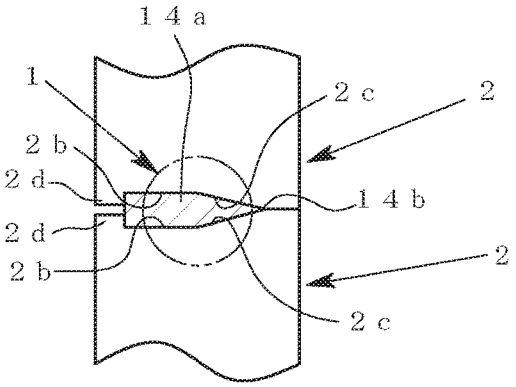
Figure 3C:
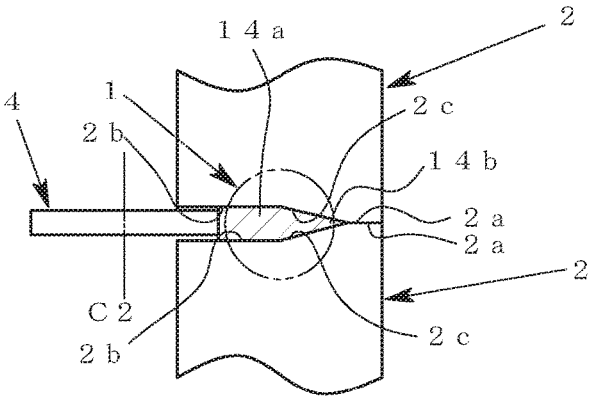
Figure 3D:
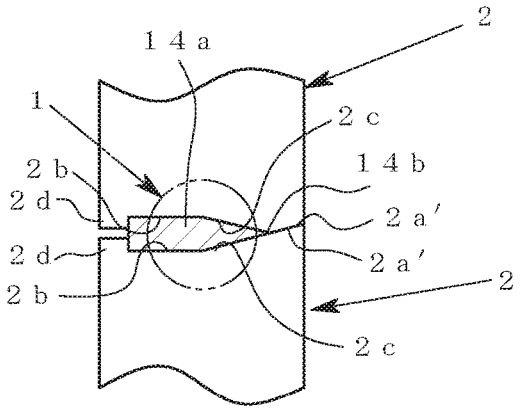
Figure 4:
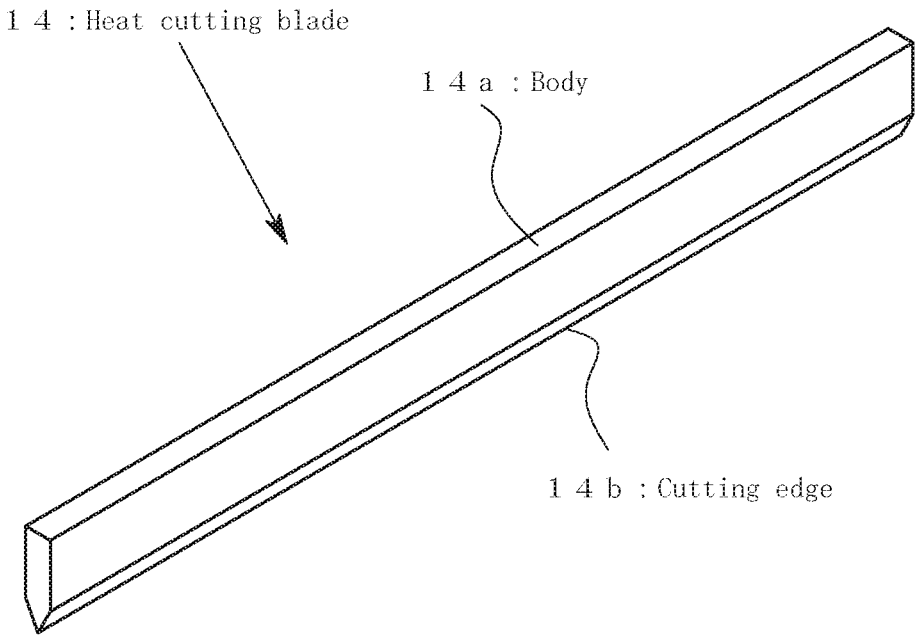
FIG. 4 is a perspective view of a heat cutting blade serving as an example of a linear cutter.

FIG. 2 is an explanation diagram of a principal part of a roller die device used in a method for molding a linear cutter according to another embodiment of the present invention.

As for the difference of the present embodiment from the previous embodiment, in contrast to the previous embodiment in which the round wire 1 having a large length in a wound form has been set in the round wire feed part 1A, a round wire 1 having been cut into a pre-set length is set in a round wire feed 1B of the present embodiment.

A plurality of the round wires 1 are set in the round wire feed part 1B of the present embodiment. Then, the round wire 1 extracted one by one is fed through a guide (not shown) to a position between the roller dies 2 and 2.

FIG. 3 shows various modes of the die hole in the roller die device of FIG. 1 or 2 and situations that each part of the linear cutter 14 is formed by these die holes, which are given in the form of partial enlarged views where the roller dies 2 and 2 are viewed from an arrow-I direction in FIG. 1 or 2.

As shown in FIG. 3(*a*), in the round wire 1 having been introduced to the position between the roller dies 2 and 2, a flat-plate shaped body 14*a* is formed by the first rolling formation surfaces 2*b* and 2*b* and, at the same time, a cutting edge 14*b* is formed at one edge of the body 14*a* by the second rolling formation surfaces 2*c* and 2*c*. At that time, in a case that the center position of the round wire 1 (a position indicated by a center line C1) is deviated toward a side opposite to the keen angle part (formed by the second rolling formation surfaces 2*c* and 2*c*) of the die hole (that is, toward the left side in the figure) by an amount greater than a fixed value, the squeezed round wire 1 does not sufficiently reach the tip of the second rolling formation surfaces 2*c* and 2*c* and hence the precision cutting edge 14*b* cannot be formed. Thus, it is preferable that the center position C1 of the round wire 1 having been introduced into the die hole is located as close as possible to the second rolling formation surfaces 2*c* and 2*c* side within an extent that the linear cutter 14 can be molded with precision.

In the example shown in FIG. 3 (*b*), in the roller dies 2 and 2, protrusions 2*d* and 2*d* along the entire circumferences of the first rolling formation surfaces 2*b* and 2*b* are formed on a side opposite to of the keen angle part of the first rolling formation surfaces 2*b* and 2*b*. The protrusions 2*d* and 2*d* suppress the progress of deformation of the round wire 1 in the inside of the die hole toward the opposite-to-the-keen-angle-part side so that the deformation of the round wire 1 is efficiently directed toward the keen angle part side. This also contributes to the precision formation of the cutting edge 14*b*.

In the example shown in FIG. 3 (*c*), in place of the protrusions 2*d* and 2*d* in FIG. 3 (*b*), another roller die 4 is provided that revolves in synchronization with the roller dies 2 and 2. The roller die 4 is freely revolvable about a revolution axis C2 perpendicular to the revolution axes C and C (see FIG. 1) of the roller dies 2 and 2 in the page of FIG. 3. Then, the rotating edge of the roller die 4 is inserted into the die hole so that the rotating edge pushes the round wire 1 in the inside of the die hole toward the keen angle part side. By virtue of this, the deformation of the round wire 1 can efficiently be directed toward the keen angle part side.

Here, not specifically shown in the figure, the roller die 4 in FIG. 3(*c*) may be employed together with the protrusions 2*d* and 2*d* in FIG. 3(*b*). In this case, it is sufficient that a gap is formed between the protrusions 2*d* and 2*d* in FIG. 3(*b*) and then the rotating edge of the roller die 4 is inserted into the gap.

In the examples shown in FIGS. 3(*a*) to 3(*c*), the contact surfaces 2*a* and 2*a* are formed as surfaces parallel to the revolution axes C and C (see FIG. 1) of the roller dies 2 and 2. In the example shown in FIG. 3(*d*), the contact surfaces are formed as contact surfaces 2*a*' and 2*a*' engaging with each other in a state of being inclined at the same angles in the same direction relative to the revolution axes C and C. As shown in the figure, when the inclination angle of one contact surface 2*a*' (the lower one in the figure) agrees with the inclination angle of the second rolling formation surface 2*c*, formation of the contact surface 2*a*' becomes easy. As such, when the inclined contact surfaces 2*a*' and 2*a*' engage with each other, the acute angle of the blade edge in the cutting edge 14*b* can be made more precise. Further, the load generated at the time of squeezing the round wire 1 causes the pair of roller dies 2 and 2 to deviate from each other in a direction parallel to the revolution axes C and C. However, when the contact surfaces 2*a*' and 2*a*' engage with each other, such a phenomenon can be suppressed. This also contributes to the molding of the higher-precision cutting edge 14*b*.

Preferred embodiments of the present invention have been described above. However, the present invention is not limited to the description given above.

For example, the pair of roller dies 2 and 2 provided in the roller die device are not limited to one pair. That is, plural pairs may be provided so that the linear cutter 14 may be formed in multistep.

Further, in the description given above, the employed wire rod was the round wire 1 having a cross section of circular shape. Instead, in the present invention, a wire rod having any other sectional shape such as an ellipse, a rectangle, and a square may be employed.

Further, in the present invention, the inclined second rolling formation surfaces 2*c* and 2*c* may be formed on both sides of the first rolling formation surfaces 2*b* and 2*b* so that a linear cutter having the cutting edges 14*b* on both sides of the body 14*a* may also be molded.

Further, in the present invention, process steps such as grinding and finishing may be added posterior to the simultaneous molding of the body 14*a* and the cutting edge 14*b* performed by the roller die device. At the time, since the body 14*a* and the cutting edge 14*b* can be molded with precision, an advantage is obtained that the time necessary for grinding and finishing can remarkably be reduced.

Further, in the example shown in FIG. 3(*d*), the contact surfaces 2*a*' and 2*a*' inclined at the same angles in the same direction as each other have engaged with each other. However, the mode of the contact surfaces is not limited to this as long as the same operation is achieved. For example, one or a plurality of depressions and protrusions may be provided. Also in the examples shown in FIGS. 3(*a*) to 3(*c*), one or a plurality of depressions and protrusions may be provided in the contact surfaces 2*a* and 2*a* for the purpose of deviation suppression.

INDUSTRIAL APPLICABILITY

In addition to a heat cutting blade used in processing or manufacturing of an interior material for automobiles or the like, the present invention may widely be applied also to molding of a linear cutter used in other applications.

The invention claimed is:

1. A method for manufacturing a linear cutter comprising the steps of:

preparing a pair of roller dies including contact surfaces inclined at angles that are the same as each other;

engaging the roller dies by contacting the contact surfaces to form a die hole for processing a wire rod into a predetermined shape, the die hole having a keen angle part for forming a cutting edge; and passing the wire rod through the die hole in a state that the roller dies revolve and thereby forming a sectional shape of the wire rod into a pre-set shape and, at the same time, forming the cutting edge at least at one edge of the wire rod through the keen angle part, wherein in the step of engaging the roller dies, the contact surfaces are inclinedly contacted to each other so that deviation between the roller dies caused by load generated when the wire rod passes through the die hole is prevented and the keen angle part is precisely formed.

2. The method for manufacturing a linear cutter according to claim 1, further comprising a step of:

cutting the wire rod into a pre-set length after the sectional shape of the wire rod is formed into the pre-set shape and, at the same time, the cutting edge is formed at least at the one edge of the wire rod, wherein in the step of passing the wire rod through the die hole, the wire rod is continuously supplied to the die hole from a wire rod feed part in which the wire rod is wound in a rolled form.

3. The method for manufacturing a linear cutter according to claim 1, wherein in the step of engaging the roller dies, each of the roller dies includes a deformation suppression part on a side opposite to the keen angle part; and in the step of passing the wire rod through the die hole, the wire rod passing through the die hole abuts against the deformation suppression part so that deformation of the wire rod toward the side opposite to the keen angle part is suppressed.

4. The method for manufacturing a linear cutter according to claim 1, further comprising the steps of:

preparing another roller die separately from the roller dies; and inserting a rotating edge of the another roller die into the die hole so that the wire rod is pressed toward the keen angle part side.

5. The method for manufacturing a linear cutter according to claim 1, wherein in the step of preparing the roller dies, the roller dies further include protrusions protruding in a direction approaching to each other at sides opposite to the contact surfaces, first rolling formation surfaces extending from the protrusions toward the contact surfaces and spaced from each other to form the die hole therebetween, and second rolling formation surfaces extending from the first rolling formation surfaces to the contact surfaces and inclined in a direction approaching to each other to form the keen angle part therebetween, and the contact surfaces extending along one of the second rolling formation surfaces, one of the contact surfaces being inclined from a connecting portion of the second rolling formation surfaces in a direction wherein a diameter of one of the roller dies becomes larger and another of the contact surfaces being inclined from the connecting portion of the second rolling formation surfaces in a direction wherein a diameter of another of the roller dies becomes smaller.

6. The method for manufacturing a linear cutter according to claim 5, wherein in the step of preparing the roller dies, the protrusions are arranged apart from each other in a protruding direction to form a space therebetween at the sides opposite to the contact surfaces.

7. A roller die device for molding a linear cutter comprising:

a pair of roller dies including contact surfaces inclined at angles that are the same as each other and contacting each other to engage the roller dies; and a die hole formed between the roller dies and having a keen angle part, through which a wire rod is adapted to pass in a state that the roller dies revolve so that a sectional shape of the wire rod is formed into a pre-set shape, and a cutting edge is formed at least at one edge of the wire rod through the keen angle part, wherein the contact surfaces are inclinedly contacted to each other so that deviation between the roller dies caused by load generated when the wire rod passes through the die hole is prevented and the keen angle part is precisely formed.

8. The roller die device for molding a linear cutter according to claim 7, wherein each of the roller dies includes a deformation suppression part formed on a side of each of the roller dies opposite to the keen angle part, and adapted to abut against the wire rod so as to suppress deformation of the wire rod toward the side opposite to the keen angle part.

9. The roller die device for molding a linear cutter according to claim 7, further comprising another roller die provided separately from the roller dies and inserted into the die hole so as to press the wire rod toward the keen angle part side.

10. The roller die device for molding a linear cutter according to claim 7, wherein the roller dies further include protrusions protruding in a direction approaching to each other at sides opposite to the contact surfaces, first rolling formation surfaces extending from the protrusions toward the contact surfaces and spaced from each other to form the die hole therebetween, and second rolling formation surfaces extending from the first rolling formation surfaces to the contact surfaces and inclined in a direction approaching to each other to form the keen angle part therebetween, and the contact surfaces extending along one of the second rolling formation surfaces, one of the contact surfaces being inclined from a connecting portion of the second rolling formation surfaces in a direction wherein a diameter of one of the roller dies becomes larger and another of the contact surfaces being inclined from the connecting portion of the second rolling formation surfaces in a direction wherein a diameter of another of the roller dies becomes smaller.

11. The roller die device for molding according to claim 10, wherein the protrusions are arranged apart from each other in a protruding direction to form a space therebetween at the sides opposite to the contact surfaces.

* * * * *